United States Patent [19]

Spears et al.

[11] Patent Number: 5,020,518

[45] Date of Patent: Jun. 4, 1991

[54] TRAVELLING ROLLER MASSAGE APPARATUS

[75] Inventors: Kevin A. Spears; Clinton J. Stafford, both of Gastonia; Kenny C. Frey, Dallas; Daniel P. Wall, Gastonia, all of N.C.

[73] Assignee: Integrity Health Systems Corporation, Gastonia, N.C.

[21] Appl. No.: 478,083

[22] Filed: Feb. 9, 1990

[51] Int. Cl.[5] ..... A61H 15/00

[52] U.S. Cl. ..... 128/52; 128/33; 128/55; 128/57

[58] Field of Search ..... 128/33, 52, 55, 57

[56] References Cited

U.S. PATENT DOCUMENTS

| | | | |
|---|---|---|---|
| 3,389,699 | 6/1968 | Mathers | 128/33 |
| 3,405,709 | 10/1968 | Mathers | 128/33 |
| 3,709,047 | 1/1973 | Zaruba et al. | 74/25 |
| 3,736,920 | 6/1973 | Mathers et al. | 128/33 |
| 3,853,121 | 12/1974 | Mizarchy et al. | 128/33 |
| 4,173,972 | 11/1979 | Kodera | 128/52 |
| 4,215,680 | 8/1980 | Okuda | 128/33 |
| 4,230,098 | 10/1980 | Uematsu | 128/33 |
| 4,412,534 | 11/1983 | Hamabe et al. | 128/52 |
| 4,422,448 | 12/1983 | Sugai et al. | 128/44 |
| 4,422,449 | 12/1983 | Hamabe | 128/44 |
| 4,430,992 | 2/1984 | Christ | 128/33 |
| 4,574,786 | 3/1986 | Hashimoto et al. | 128/52 |
| 4,576,149 | 3/1986 | Otuka et al. | 128/33 |
| 4,656,998 | 4/1987 | Masuda et al. | 128/57 |
| 4,686,967 | 8/1987 | Hashimoto et al. | 128/57 |
| 4,718,408 | 1/1988 | Barreiro | 128/52 |

*Primary Examiner*—Edgar S. Burr
*Assistant Examiner*—Eric P. Raciti
*Attorney, Agent, or Firm*—Fitch, Even, Tabin & Flannery

[57] ABSTRACT

A massage apparatus includes a travelling carriage having a housing enclosing a drive motor and a kneading motor. A pair of guide bars extend through the housing providing stability therefor as the carriage is traversed along an intermediate drive bar which also extends through the housing. The drive motor is coupled to the drive bar through a pinion gear. Massaging elements are mounted on a crank arm which is rocked back and forth by the kneading motor. An eccentric arm couples the kneading motor to the crank arm and provides the kneading action. A control system also mounted to the carriage reverses direction of the drive motor as ends of the drive bar are approached. A massage motor is attached to the carriage housing to apply a multidirectional vibrational waves to a user through the massage elements.

16 Claims, 7 Drawing Sheets

TRAVELLING ROLLER MASSAGE APPARATUS

BACKGROUND OF THE INVENTION

1. Field of the Invention

The present invention pertains to massage apparatus of the type installed in a chair or the like fixture. More particularly, the present invention pertains to such massage apparatus having travelling rollers for applying a multiple mode therapeutic massage to a user.

2. Description of the Related Art

Efforts have been directed to developing therapeutic massage assemblies incorporated in chairs, tables and beds. For example, U.S. Pat. No. 3,389,699 discloses a chair having a roller massage assembly. A plurality of spherical rollers are mounted on a travelling carriage, which is chain-driven to travel along a track. A vibrating motor is associated with the travelling carriage, and a motor remote from the carriage, is located in a stationary part of the chair to drive the chain. The track is located in the chair back and in operation, the travelling carriage travels up and down, along a user's back. In order to soften pressure applied to a user's back, the travelling carriage is spring-loaded. However, it is difficult for such a unit to apply a more vigorous massage if such is desired by a user of the apparatus. U.S. Pat. No. 3,405,709, by the same inventor as U.S. Pat. No. 3,389,699, also discloses a travelling carriage mounted on a track for movement in a chair back. The travelling carriage is suspended by arched springs which are driven along the guide track by a chain drive system.

U.S. Pat. No. 3,709,047 discloses a travelling carriage having a plurality of bi-lobed rollers, forming part of a travelling carriage assembly. The carriage is mounted for reciprocation along a central support shaft. The shaft is rotated by a remotely located stationary drive unit and drive wheels contact the rotating shaft, imparting a reciprocal drive force to the travelling carriage. Guide cables, parallel to the central shaft, control the angle of contact between the drive wheels and rotating shaft and thereby control the direction of carriage reciprocation. The massage rollers are spring-loaded to avoid user discomfort, but the unit is not able thereby to develop the force necessary for a vigorous massage, should such be desired. U.S. Pat. No. 3,736,920 discloses similar bi-lobed rollers mounted on a travelling carriage which reciprocates along a central support shaft. Rubber shock absorbers isolate the massage rollers from the central support shaft and thus result in an inefficient energy consumption. Drive wheels, direction-reversing cables and external rotary drive for the support shaft, similar to those described above for U.S. Pat. No. 3,376,920, are also provided.

U.S. Pat. No. 4,576,149 discloses a massage assembly mounted in a chair back, having a pair of coaxially mounted massaging rollers. The rollers extend between a pair of geared tracks and a drive motor is provided with a carriage to move the carriage upwardly and downwardly along the tracks. The massage wheels are mounted to the travelling carriage through connecting arms which limit pressure applied to a user as the carriage travels along the user's back.

U.S. Pat. No. 4,656,998 discloses a massage bed having reciprocating rollers mounted on respective shafts, the ends of which are guided along guide tracks which extend the length of the bed. Commonly assigned U.S. Pat. Nos. 4,422,448; 4,422,449; and 4,574,786 disclose similar reciprocating arrangements.

Substantial improvements to massage apparatus are still being sought. As with many other commercial devices available today, massage apparatus can be comprised of relatively complex sophisticated electrical and mechanical subsystems. In today's competitive environment, it is important to realize as many manufacturing advantages as is possible, consistent with offering a full-featured reliable product.

In manufacturing sophisticated electromechanical devices, it is advantageous to confine electrical components to a localized portion of the overall assembly. Numerous advantages can be attained if the electrical components are located in a single housing or other subassembly. For example, electrical testing can be completed at the assembly site of the housing, and frequently the same test equipment can be used to examine components before assembly, and to test the various circuits of the device after construction is completed. Also, it is desirable for reasons of electrical safety that electrical components be housed within an enclosure, rather than being openly mounted at various locations throughout a chair back or other furniture structure, for example. Further, it is desirable to physically isolate low voltage control circuits from higher voltage motors and other components operating at line voltage.

Further, only the assembly site of the electrical housing need be kept clean and those aspects of fabrication involved with spraying, applying caustic solutions, and metal working, which generate metal filings and the like, need not be restricted since those operations can be carried on remotely from the electrical assembly site. Also, in many applications, labor is more efficiently divided between those workers assembling the electrical and the mechanical components, respectively. Further, those manufacturing sites operating on a "just-in-time" basis, can start fabrication and testing of electrical components as early as is needed to accommodate the more complicated and time consuming electrical testing. At times, it may be necessary to fabricate and test a number of electrical subassemblies in advance of the final assembly operation, and if the electrical components can be assembled in a single compact housing, savings and storage can be realized.

If possible, it is desirable to provide a massaging apparatus which is gentle for some users, while being able to provide a more vigorous massage desired by other users. As mentioned above, it is common to provide resilient elements in the drive systems of massaging apparatus. The resilient elements have been added to "smooth out" any erratic or unexpected motion of the massaging elements which inevitably result from the manner in which the massaging elements are suspended and are driven along their range of travel. Some resilient mountings having been successful in minimizing irregular excursions of the massaging elements. However, such resilient elements absorb energy which would otherwise be available on demand when a more vigorous massage is desired.

The travelling roller systems heretofore available reciprocate the rollers along a user's back. Other types of massage, such as a kneading massage are in demand, and it is desirable to provide a kneading action if such can be done without substantially increasing the size or expense of a massage apparatus. It is desirable to provide a travelling roller apparatus which adequately supports massaging elements during a kneading operation, while allowing reciprocal travel without a binding or irregular movement of the travelling massaging elements.

SUMMARY OF THE INVENTION

It is an object according to the present invention to provide massaging apparatus having travelling roller massaging elements.

It is another object according to the present invention to provide massaging apparatus of the above-described type which is adapted to provide a kneading massage.

A further object according to the present invention is to provide a massaging apparatus of the above-described type in which the electrical components thereof are localized in a single subassembly associated with the apparatus.

Yet another object according to the present invention is to provide a massaging apparatus of the above-described type which is inexpensive, light weight, and can be fabricated from a minimum number of relatively inexpensive parts.

These and other objects according to the present invention which will become apparent from studying the appended description and drawings, are provided in a massage apparatus comprising:

track means;

a travelling carriage mounted for movement along the track means;

a housing on said carriage;

at least one massaging element carried by said housing; and a pair of motors in said housing, including a drive motor for driving said carriage along said track means, and a kneading motor for driving said massaging element with a pulsating pressure.

Other aspects according to the present invention are provided in a massage apparatus comprising:

a pair of spaced guide bars;

a travelling carriage mounted for movement along the pair of spaced guide bars, between first and second end portions;

a housing on said carriage;

at least one massaging element carried by said carriage;

a drive bar between said guide bars;

a drive motor in said housing for driving said carriage along said drive bar, and said pair of guide bars and at least a portion of said drive bar extend through said housing.

Other objects of the present invention are attained in a massage apparatus of the above-described type having tubular bushings extending through the housing for receiving the tracks. The bushings in one embodiment comprise cylindrical tubes having threaded ends. Threaded nutlike fasteners secure the ends of the tubes to the housing to provide an economical and readily adaptable construction.

In several embodiments of the present invention, at least part of the gear rack extends through the housing to engage the output of the drive motor carried within the housing. The drive motor is thus enclosed for electrical safety, and moving parts of the gear drive are shrouded to provide an additional measure of safety.

Various embodiments of the present invention attain numerous advantages when a kneading motor is employed. It is preferred that the kneading motor be unidirectional in its output, and that a cam be mounted on the output shaft. Massage elements, preferably rotatably-mounted rollers, are mounted on a dogleg arm, one end of which contacts the cam so as to drive the massage elements with a periodic, pulsating movement.

As mentioned, the preferred kneadinq motor is unidirectional in its output. In contrast, the preferred drive motor has a reversible output and preferred embodiments of the present invention employ a control system for reversing the direction of drive rotation. In one embodiment, sensors are mounted at the ends of the gear rack and are coupled to a control circuit. The control circuit is coupled to the drive motor and supplied control signals thereto which cause the drive motor to reverse its output rotation. In one preferred embodiment, a vibration-producing motor is attached to the carriage and incorporates a control housing for protection of the control circuit.

In one embodiment, two pairs of massage rollers are driven by the kneading motor. Massage elements of each pair laterally oppose one another and are mounted on respective doglike arms. Free ends of both doglike arms contact the same cam mounted to the kneading motor output shaft. The cam can have a common lobe surface for both doglike arms or may have multiple lobe surfaces, one for each arm. The speed of the drive motor and the kneading motor could be made independently adjustable, although such has not been found necessary. Also, independent control is provided for a vibration-producing motor mounted to the carriage. Any of these three systems of motors can be independently controlled and can be stopped as desired by a user at any point in their operation.

As can be seen herein, the present invention provides multiple modes of massage to a user. The vibration-producing motor, when employed, produces a vibration at different points, location and number of which are controlled by the user. For example, the kneading motor can be controlled to bring one or both pairs of massage elements in contact with the user. Thus, two or four points of vibration can be selected by a user, and the location thereof can also be adjusted by control of the drive motor. A user can traverse the carriage back and forth along the gear rack, with or without vibration being provided. In addition, a user can activate the kneading motor to provide a kneading action of the massage elements as the carriage is traversed back and forth. Alternatively, the kneading motor can be energized to provide a kneading action with the carriage maintained at a stationary position. In addition, vibration action can be added to the massage elements upon demand. Also, if desired, the rates of motion of the kneading action, carriage travel, and vibration could be independently controlled by the user to attain a wide variety of multi-mode massage.

BRIEF DESCRIPTION OF THE DRAWINGS

In the drawings, wherein like elements are referenced alike.

DETAILED DESCRIPTION OF THE PREFERRED EMBODIMENT

Figure 1:
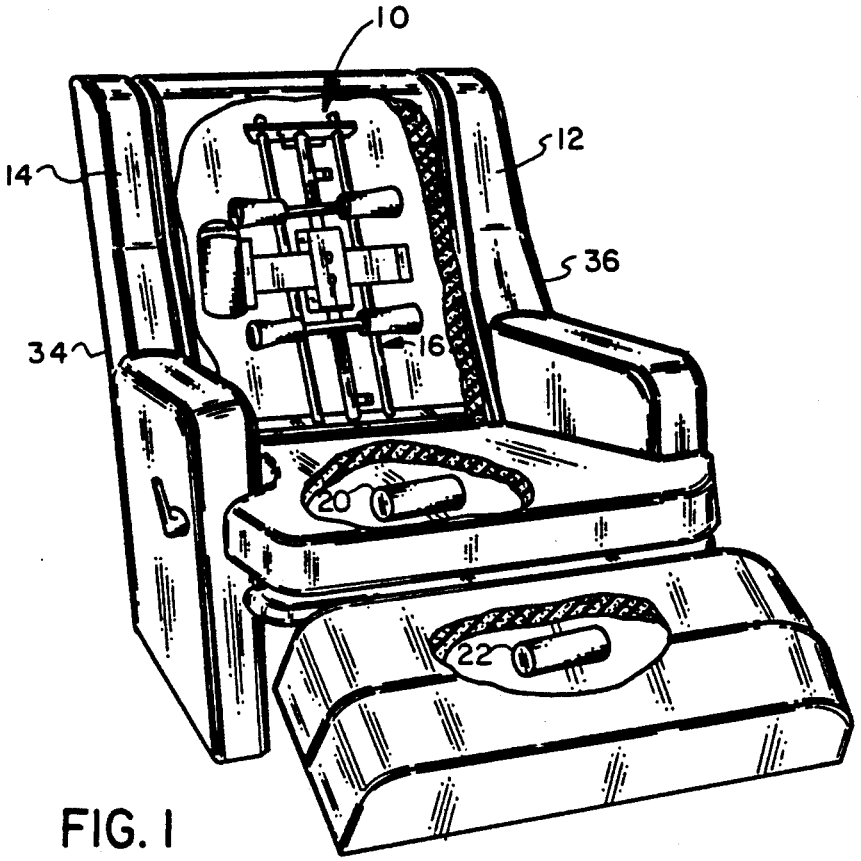
FIG. 1 is a perspective view of a chair, shown partly broken away to reveal massaging apparatus according to the present invention.
Figure 2:
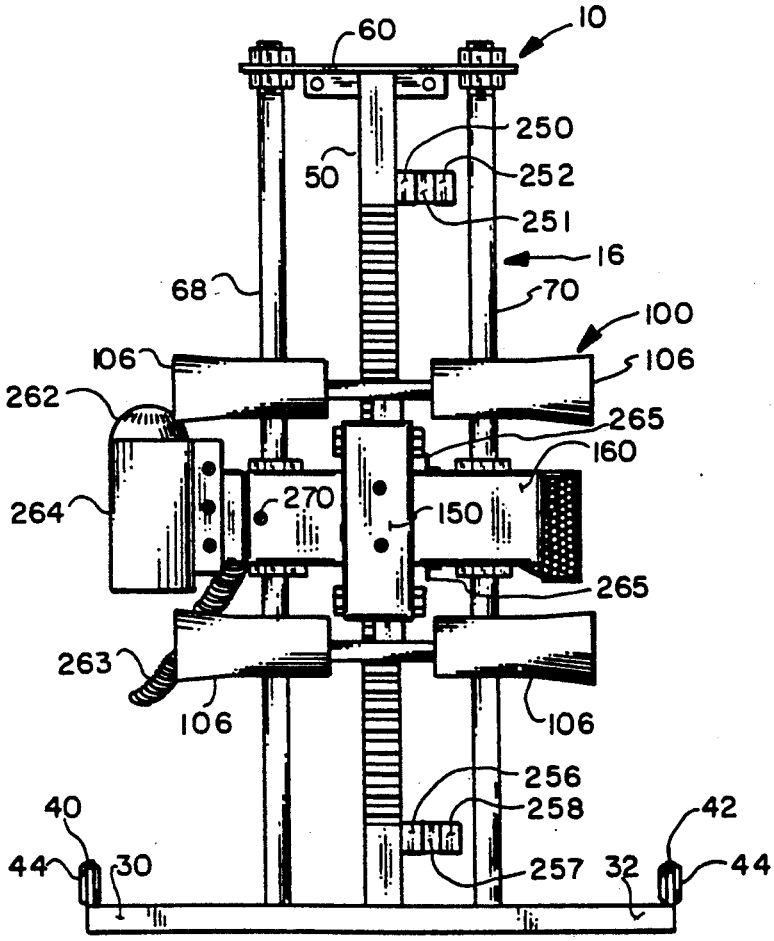
FIG. 2 is a front elevational view of the massage apparatus of FIG. 1.

Referring now to the drawings and especially to FIGS. 1 and 2, a massage apparatus generally indicated at 10 is shown installed in the cushioned back 12 of a chair 14. The apparatus 10 includes a frame 16 (see FIG. 3), which includes features for convenient mounting to the chair, bed, table, or suitable fixture. As will be seen herein, a vibrating motor, such as one setting up multidirectional vibration waves, is included with the massage apparatus to further enhance the massage therapy possible with the present invention. Also illustrated in FIG. 1 are additional vibrating units 20, 22 located in the seat and footrest portions of the chair. The vibrating units 20, 22 are not associated with the massage apparatus and may be omitted, if desired.

Figure 3:
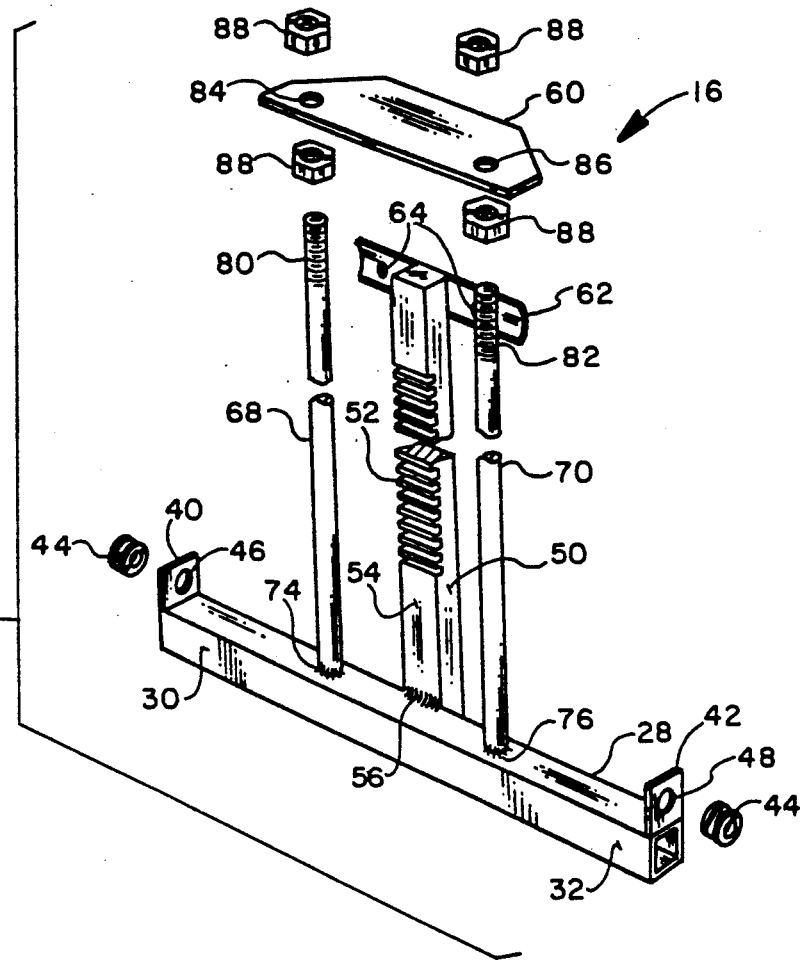
FIG. 3 is a perspective view, shown exploded, of the guide track and gear rack assembly of the massage apparatus.

Referring additionally to FIG. 3, frame 16 includes a base member 28, preferably of tubular construction, having opposed ends 30, 32, mounted at the lateral sides 34, 36 of chair 14 by upstanding ears 40, 42. If desired, grommets 44 can be employed in mounting holes 46, 48 of the mounting ears 40, 42, respectively. Preferably, the ends of base 28 are secured directly to the structural frame of chair 14. Frame 16 further includes a plurality of vertically extending elongate guide track and gear rack members which provide drive and guidance for the travelling carriage of the massage apparatus 10. Frame 16 includes a central drive bar, preferably in the form of a rack member 50, having a plurality of teeth 52 formed in the forward surface 54 thereof. The wide tracks 68, 70 are located on either side of the gear rack.

The rack 50 is welded at its lower end at 56 to base member 28, and is threadingly secured at its upper end to a mounting plate 60. A laterally extending mounting bracket 62, having apertures 64 therein for direct mounting to a support frame of chair 14, is welded to the lower ends of guide bars 68, 70. As will be seen herein, the rack 50 mates with a pinion gear carried by the travelling carriage to provide a drive system therefore.

Frame 16 also includes a pair of guide tracks or bars 68, 70 mounted on either side of rack 50 by welded joinders 74, 76, respectively. The guide bars 68, 70 preferably have a circular cross-section, but may also have virtually any cross-sectional configuration that may be desired.

The upper ends of guide bars 68, 70 are threaded at 80, 82, respectively, and are received in mounting apertures 84, 86 formed in mounting plate 60. The threaded portions 80, 82 are secured to mounting plate 60 by pairs of threaded nut fasteners, to provide a locking which resists loosening, despite vibration experienced in the guide bars and other components of frame 16. Four threaded fasteners 88 are employed. The threaded securement of guide bars 68, 70 provides easy removal of carriage 100, as well as an adjustment for the guide bars relative to rack 50 to aid in alignment of the massage apparatus.

Figure 4:
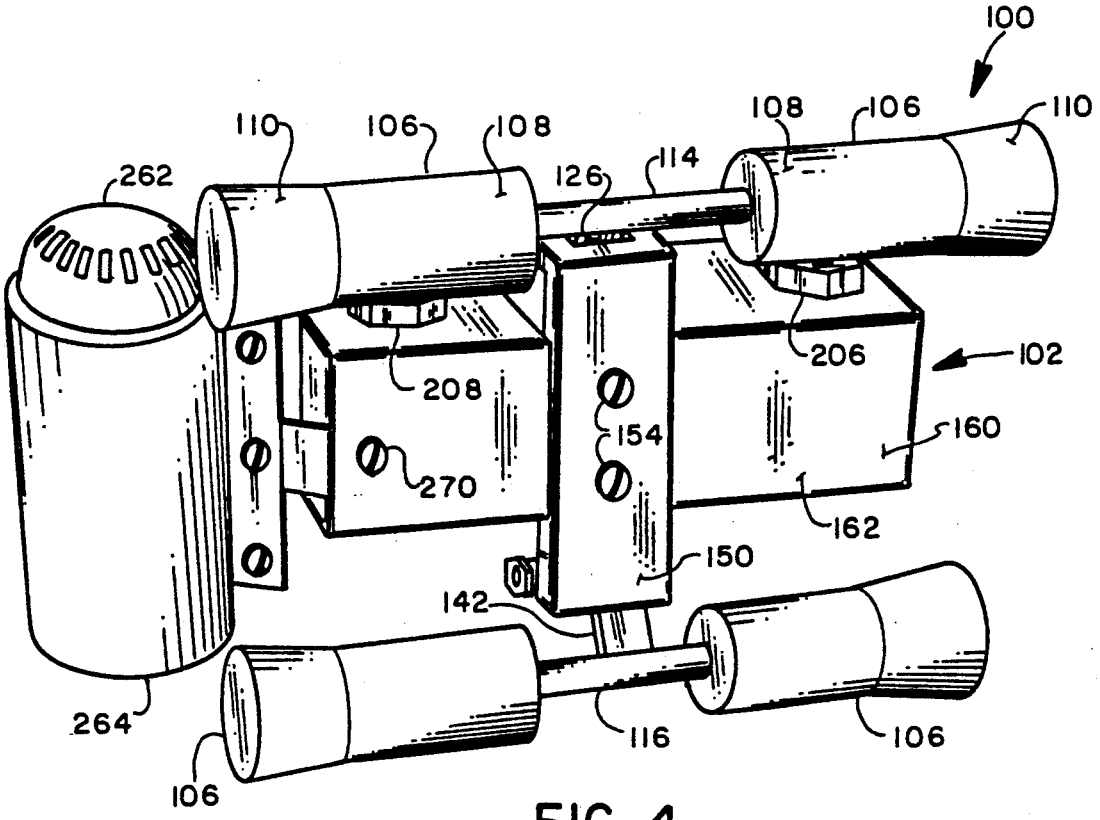
FIG. 4 is a perspective view of the travelling carriage of the massage apparatus.

Referring now to FIG. 4, the travelling carriage of massage apparatus 10 is generally indicated at 100. Together, the travelling carriage 100 and the frame 16 comprise massage apparatus 10, the carriage 100 travelling back and forth along the central longitudinal axis of frame 16. As will be seen herein, the travelling carriage 100 can include the electrical components of apparatus 10, being conveniently fabricated as a complete subassembly. An important feature of travelling carriage 100 is the housing 102, preferably made of sheet metal material, which encloses the electrical motors of the travelling carriage, thereby providing an added measure of safety.

The massage apparatus according to the present invention applies massage therapy through a plurality of massage applicators 106. In the preferred embodiment, four rollers 106 are employed, and the massage applicators comprise rollers mounted for rotation about their central longitudinal axis. The rollers have a first generally cylindrical body portion 108 and an outwardly diverging frustoconical end portion 110. Preferably, the rollers are made of NITRILE rubber of a desired density, but the rollers can be made of any suitable material. In the preferred embodiment, the rollers 106 are arranged in upper and lower pairs, each pair comprising laterally spaced massage applicators. The lateral spacing is preferably chosen such that the cylindrical portion 108, as well as the frustoconical end portion 110, both apply massaging pressure to a user's back.

Figure 7:
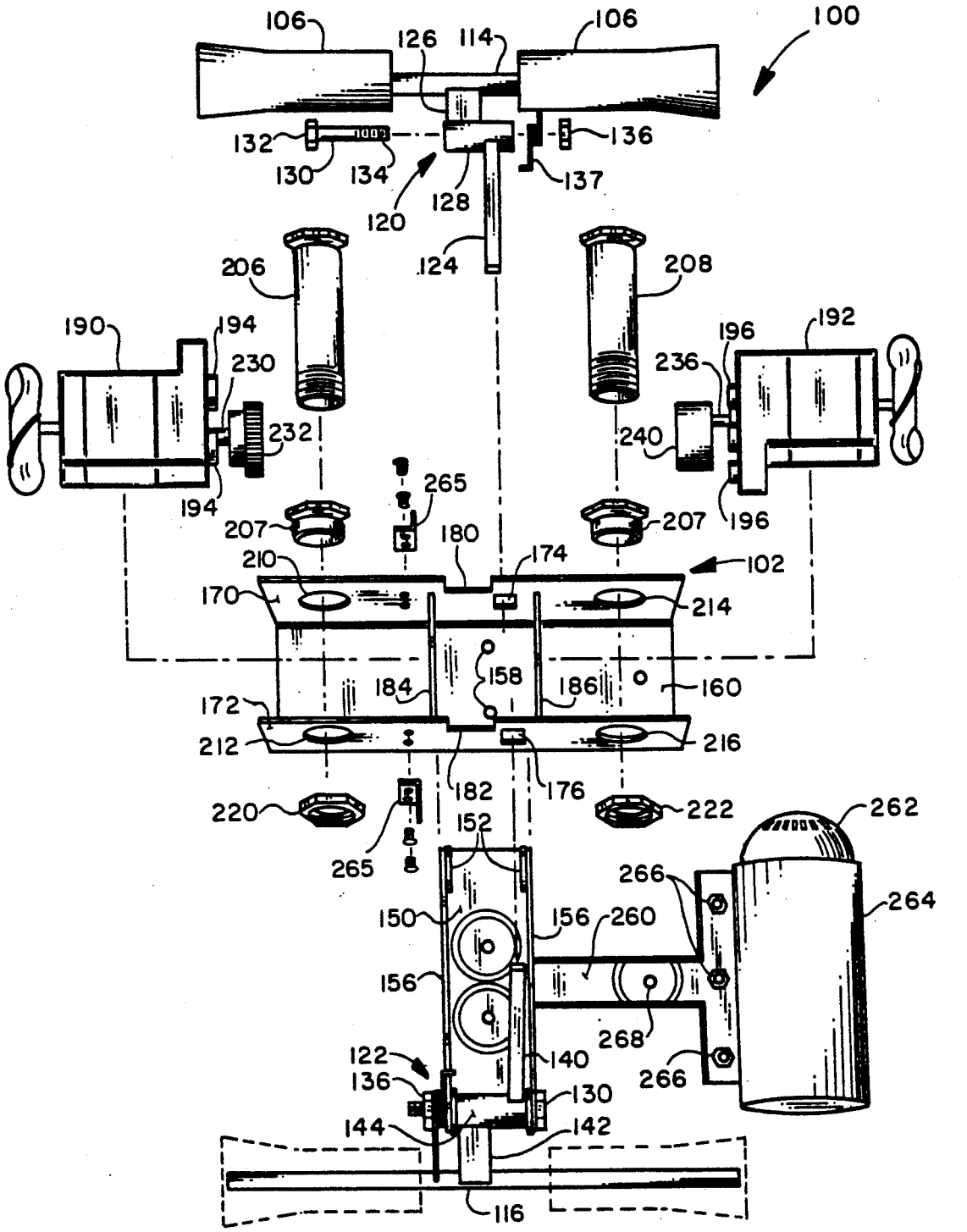
FIG. 7 is an exploded perspective view of the travelling carriage.

Referring to FIG. 7, the rollers 106 are mounted in pairs at opposite ends of a cross arm member. In the preferred embodiment, upper and lower cross arms 114, 116, are employed. The rollers 106 are preferably provided with an axially extending recess for receiving the free ends of the cross arm and provision is made to lock the roller to the cross arm 114 once installed thereon. The ends of the cross arm 114 function as a central shaft for rotatably mounting the rollers. As will be seen herein, carriage 100 translates along the drive rack 50 and thus, when pressure is applied to a pair of rollers 106, the rollers are free to rotate as they traverse the chair back 12.

Figure 8:
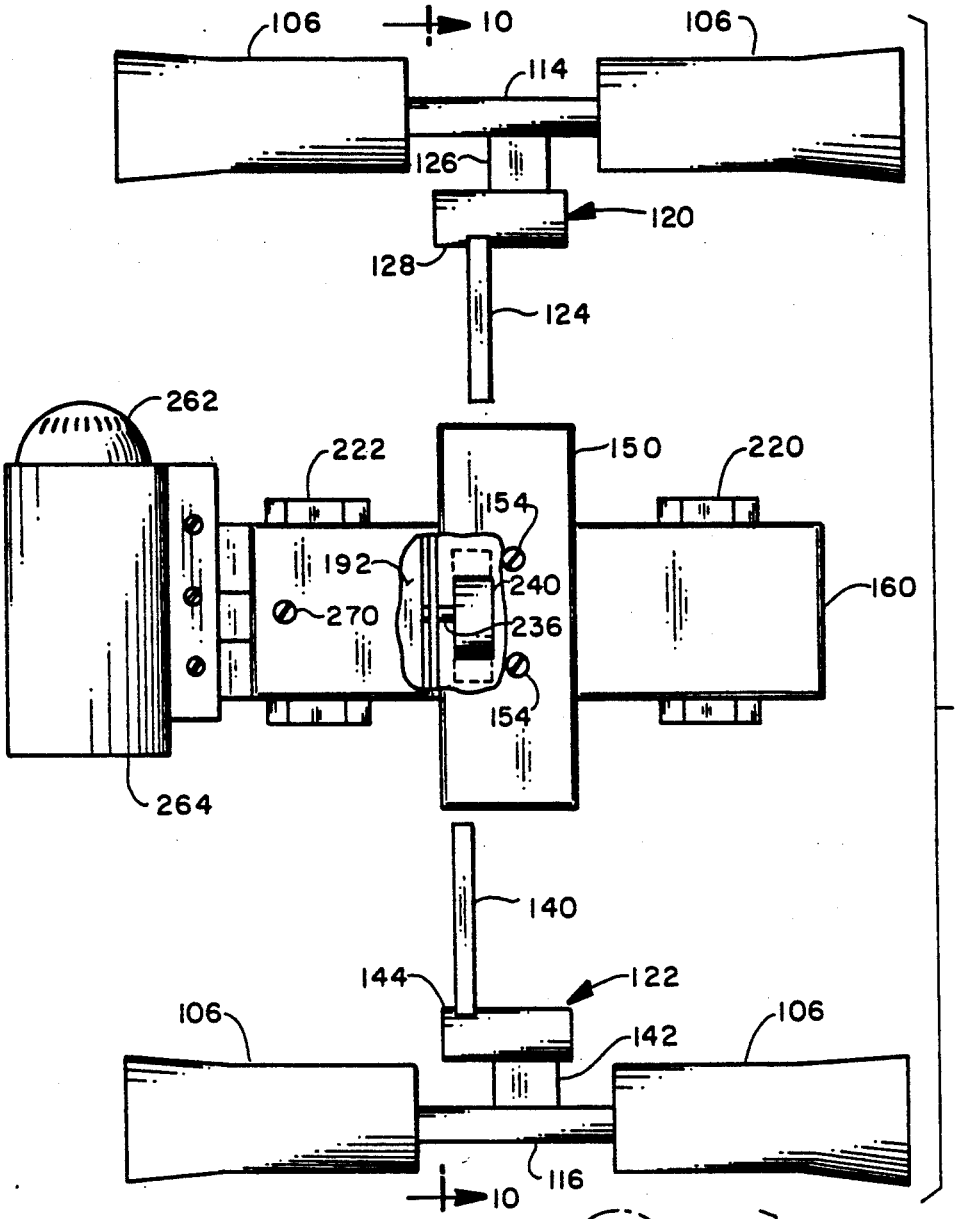
FIG. 8 shows the travelling carriage in a partially exploded view.
Figure 10:
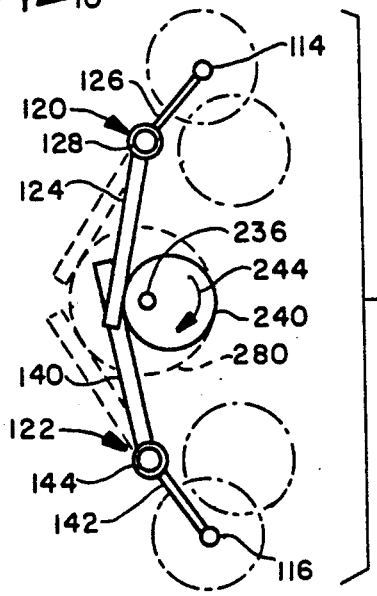
FIG. 10 is a diagrammatic view illustrating the kneading action of the massaging applicators.
Figure 9:
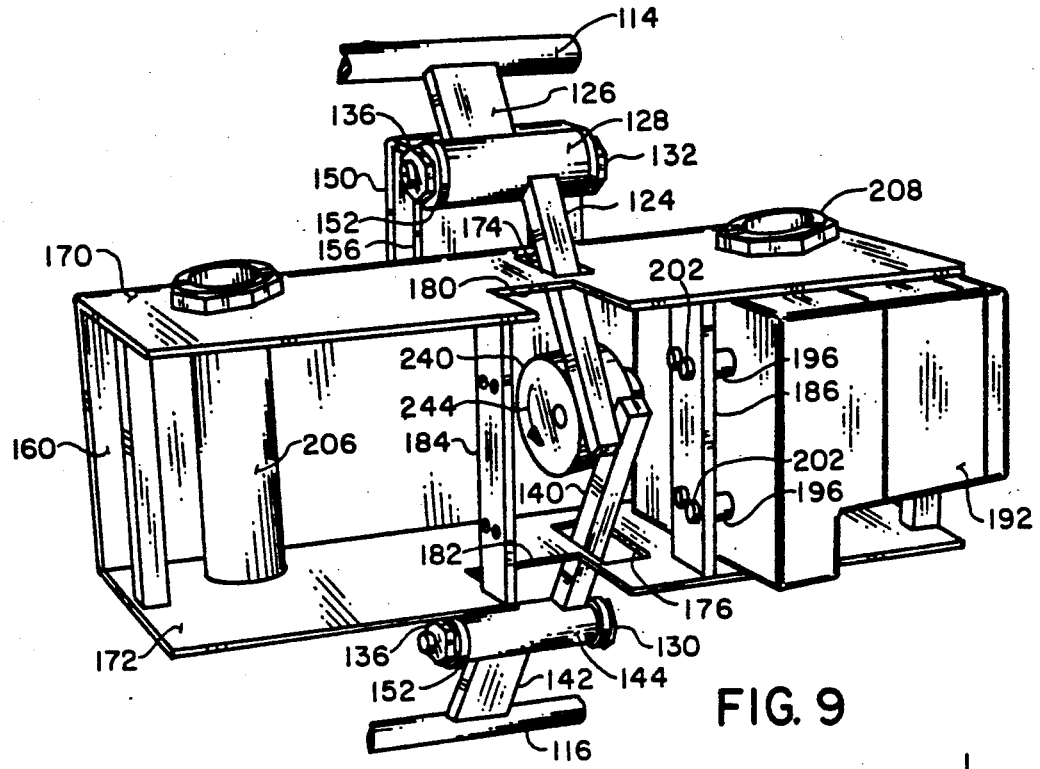
FIG. 9 is a rear perspective view similar to that of FIG. 6, but with various components omitted for purposes of illustration.
Figure 11A:
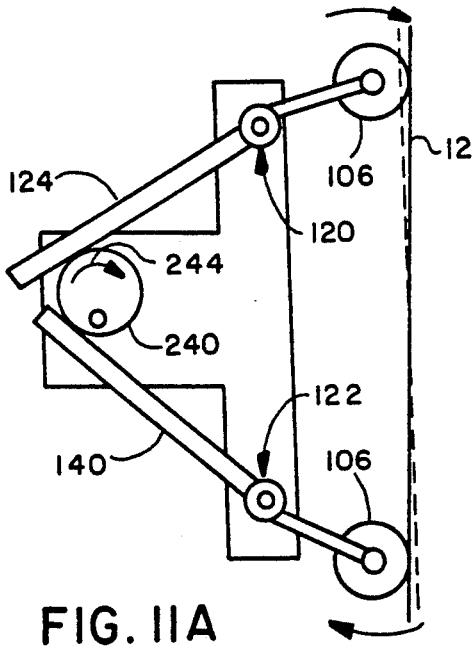
FIGS. 11*a*–11*c* show a sequence of operation of the massaging applicators.
Figure 11B:
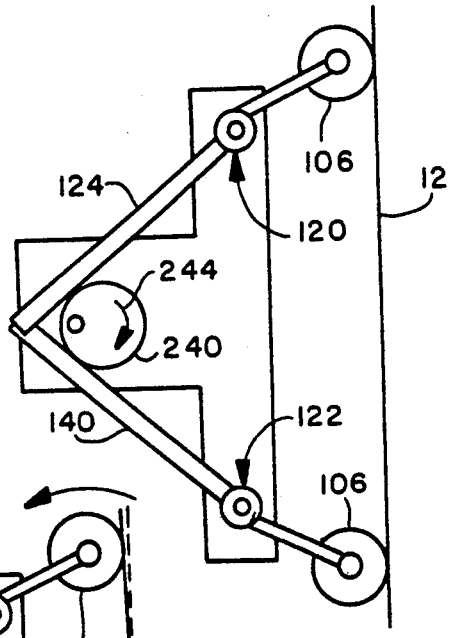
Figure 11C:
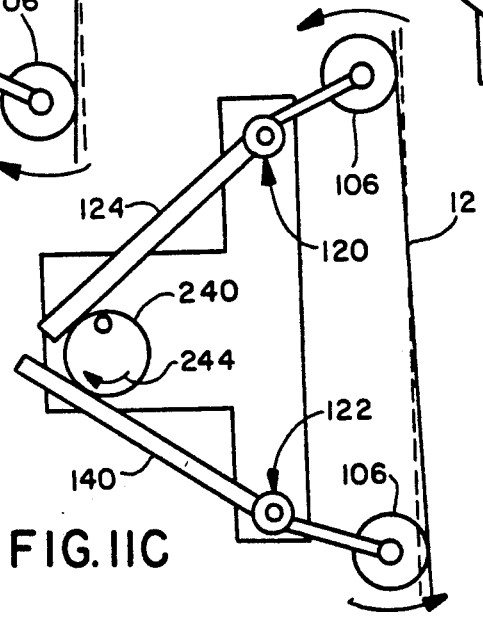

The cross arms 114, 116 are secured to crank arms 120, 122, respectively, preferably by welding. As can be seen in FIGS. 9–11, the crank arms 120, 122 are generally V-shaped in side profile. The upper crank arm 120 has an inner or inwardly extending leg 124 and an outer leg 126. As can be seen in FIGS. 7 and 8, for example, the inner and outer legs 124, 126 are laterally offset one from the other, but extend in generally the same longitudinal direction (except for the slight dogleg or V-shaped offset). The legs 124, 126 are joined at opposed ends to a cylindrical pivot bushing 128. The pivot bushing 128 has a central cylindrical recess for receiving a pivot fastener 130, therethrough. In the preferred embodiment, pivot fastener 130 comprises a conventional bolt fastener having a head 132, and a threaded end portion 134, for receiving a threaded fastener nut 136.

Also, it is preferred that the inner cam-contacting portions of legs 124, 140 be biased toward the cam 240, and a helical spring 137 is provided for this purpose, so as to maintain quiet operation of the massage apparatus.

If desired, the travelling carriage could be provided with a single pair of rollers 106 and, optionally, one of the rollers could be omitted and numerous features of the present invention would still be obtained. However, it is preferred that the actuating mechanism for the massage applying rollers be located generally centrally between the rollers, and that two pairs of rollers be provided. Accordingly, in the preferred embodiment, a lower cross arm 116 is included, and is joined to a lower crank arm generally indicated at 122. The lower crank arm, in general, comprises a mirror image of the upper crank arm 120 and includes inner and outer legs 140, 142 respectively, which are slightly laterally offset one from another and which are joined at opposed ends to a pivot bushing 144. As can be seen in FIGS. 9–11, the lower crank arm 122 also has a V-shaped configuration when viewed from the side.

Travelling carriage 100 includes a mounting plate 150, with pairs of upstanding mounting ears 152 spaced apart so as to receive the pivot bushings 128, 144, therebetween. Apertures formed in the mounting ears 152 receive the threaded bolt-like pivot fasteners 130. The plate 150 is preferably secured to housing 102 by screw fasteners 154 (see FIG. 4), to the middle wall 160 of housing 102. The screw fasteners 154 are received in apertures 158 in the middle wall 160, the rear surface 156 of plate 150 engaging the forwardly facing exterior surface 162 of wall 160.

Figure 5:
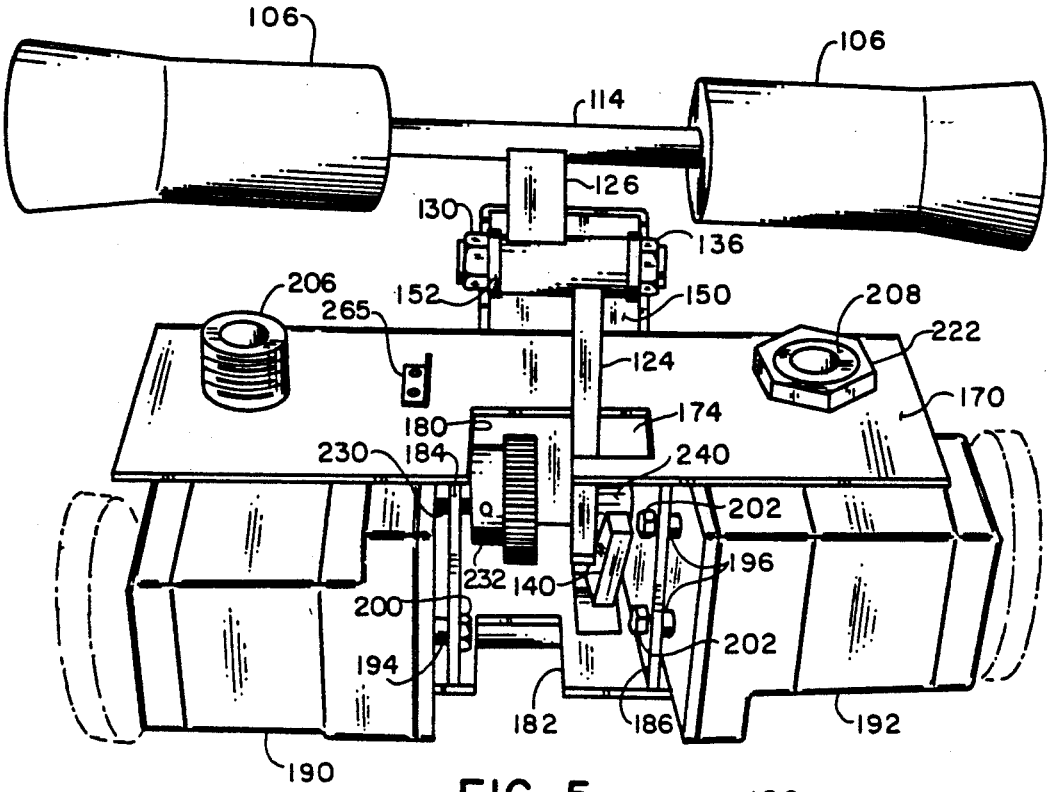
FIG. 5 is a rear perspective view of the travelling carriage of FIG. 4.

The crank arms 120, 122 are thereby pivotally mounted, free to rotate about the central longitudinal axis of their respective pivot bushings. FIG. 10 shows the range of movement of the crank arms when mounted in apparatus 10. In general, the cross arms 114, 116 swing about an arcuate path in directions toward and away from the chair back 12. This range of motion makes possible a kneading action of the massage applicators, in addition to a travelling motion or transaction movements, as the carriage reciprocates back and forth along guide rack 50. As illustrated in FIG. 5, the inner legs 124, 140 of the upper and lower crank arms are laterally offset from the centerline of the carriage, and also from one another to thereby provide a side-by-side alignment when mounted in apparatus 10. Thus, in this illustrated embodiment, the inside legs 124, 140 can overlap or cross one another at their free ends, thereby allowing both crank arms to be driven by a single cam. In another preferred embodiment, the inside legs 124, 140 are laterally offset from the centerline of the carriage, but are aligned with one another so as to be nearly butted end-to-end. In order to prevent interference, the legs 124, 140 are shortened so as not to overlap and so as to ride on the same path on cam 240.

Figure 6:
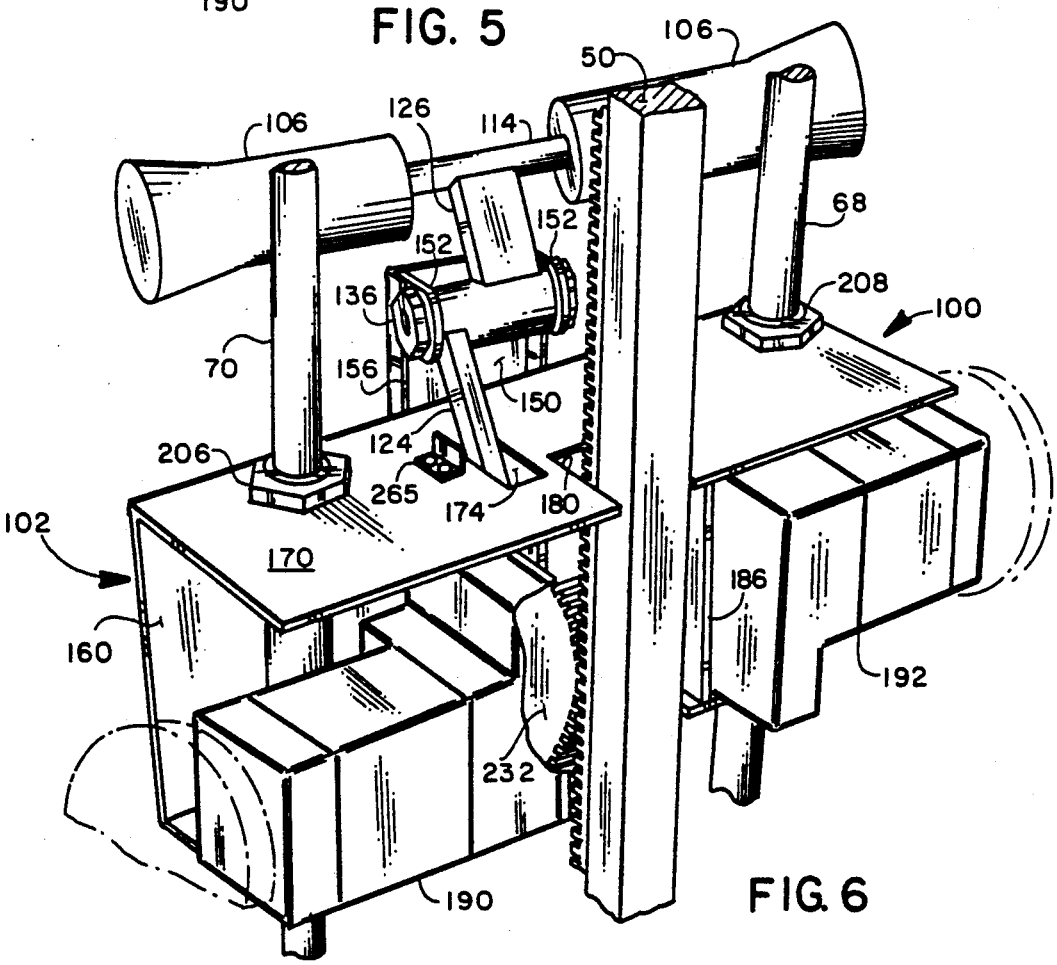
FIG. 6 is a fragmentary perspective view showing the travelling carriage mounted on a drive track.

Referring again to FIG. 7, housing 102 includes top and bottom walls 170, 172 integrally joined to middle wall 160 to form a U-shaped cross-section. The inner legs 124, 140 are received in apertures 174, 176 formed in walls 170, 172, a construction which affords a maximum protection of the electrical components and moving components located within housing 102. The apertures 174, 176 are located to the same side of recesses 180, 182 which provide clearance to receive the drive rack 50, as illustrated in FIG. 6.

Housing 102 includes a pair of internal spaced-apart internal walls 184, 186. According to one important feature of the present invention, a pair of laterally opposed electric motors are mounted within housing 102. These motors provide linear, reciprocating drives for the travelling carriage and a drive side-by-side for the kneading action of the massage rollers. The electric motors 190, 192 are illustrated in FIG. 7, and can be seen to have opposed output shafts facing one another in an inward direction. The motors 190, 192 include internally threaded mounting bosses 194, 196, for receiving threaded bolt fasteners 200, 202, respectively. The motors are butted against walls 184, 186 and the threaded fasteners 200, 202 are inserted through apertures in the walls, to mount the motors thereto in the manner illustrated in FIG. 5, for example.

A pair of low friction bushings 206, 208 are provided to receive the guide bars 70, 68, respectively. Bushing 206 is inserted through apertures 210, 212 in walls 170, 172 of housing 102. Similarly, bushing 208 is inserted in apertures 214, 216 formed in the upper and lower housing walls. Bushings 206, 208 have threaded portions at each end for receiving threaded nut 220, 222. In the preferred embodiment, bushings 206, 208 are formed of NYLON but could be made of any suitable low friction material suitable for service, as a durable bearing member capable of withstanding the friction forces experienced during operation of the massage apparatus. The nut fasteners are also preferably formed of NYLON but could be formed of metal, if desired, since they do not come in contact with the guide bars 68, 70. In the preferred embodiment, short grommet-like flanged inserts 207 of NYLON material are interposed between the bushings and the edges of the carriage housing.

Other constructions could be employed for the bushings. For example, metal bushings lined with a low friction material such as (UHMW) plastic, TEFLON, NYLON or the like could be employed. Alternatively, a plurality of ball bearing races could be installed in the bushings, but such is generally not preferred due to cost restraint. The one-piece bushing, configured to provide a compressive locking force to housing 102, is an important feature in the economical manufacture of the massage apparatus. Further, the threaded securement of the bushing to the housing to provide a compressive retention, is preferred for ease of installation.

With the motors and bushings installed in housing 102, the crank arm and roller assemblies are mounted to plate 150, with the inner ends of the crank arms protruding into housing 102. The threaded nut fasteners 88 and mounting plate 60 are removed from guide bars 80, 82 (assuming preassembly of those items), and the guide rods and drive rack are free at their upper ends for mounting of the carriage assembly thereon. The carriage assembly 100, as shown in FIG. 4, for example, is aligned with the upper free ends of the guide bars and drive rack and is pushed downwardly over those components in the manner illustrated in FIG. 6, for example. The guide bars 70, 68 are received in bushings 206, 208, respectively and drive rack 50 is received in the notches or recesses 180, 182 formed at the rear edge of housing 102.

As shown in FIGS. 5 and 7, for example, drive motor 190 includes an output shaft 230 which extends toward the kneading motor 192. A pinion gear 232 is secured to the output shaft 230, and as illustrated in FIG. 6, meshes with the teeth of drive rack 50. Referring additionally to FIG. 8, motor 192 has an output shaft 236 carrying an eccentric cam 240. As indicated in FIG. 9, cam 240 is dimensioned to contact both inner legs 124, 140 to simultaneously control both upper and lower crank arms 120, 122. The laterally offset legs of crank arms 120, 122 cooperate to be driven from the single cam, at one side of gear rack 50. Those skilled in the art will readily appreciate that cams having other shapes can be employed, and further that the cam 240 having a single peripheral surface can be replaced with two cams pressed together, one for each inner leg, to tailor the excursion of the massaging rollers as desired. The cams need not be cylindrical, but can take on any shape desired, such as an elliptical or egg-shaped configuration. Also, as mentioned, the inner legs can be shortened and colinearly aligned with one another so as to travel the same path on the cam.

According to one aspect of the present invention, the drive motor 190 reverses its direction of rotation in response to a control signal, thereby providing carriage travel in upward and downward directions. In contrast, the kneading motor 192 has output rotation in the constant direction indicated by arrow 244 (see FIG. 9). In the preferred embodiment, sensors 250, 252 are connected to rack 50, adjacent the upper end of frame 16 to detect the presence of travelling carriage 100 at its uppermost position. Leads from the sensors are carried in the hollow interior of rack 50. The sensors 250, 252 operate preferably in the infrared region with the signal path therebetween being broken by travelling carriage 100. Sensors 250, 252 could however operate at different frequencies, as desired. Similarly, a lower pair of sensors 256, 258 are located adjacent the lower end of frame 16 to detect the lower most point of travel of carriage 100. The sensors 250, 252 are connected to an electronic control circuit carried by the chair, or housed within the travelling carriage. For example, an electronic control circuit can be attached to arm 260 which mounts the housing 264 of vibrating massage motor 262, the circuit being at least partly enclosed by a control enclosure comprised of the metallic arm and housing members 260, 102. As shown in FIGS. 4 and 7, the vibration motor mechanism is mounted by a screw fastener 270 received in aperture 268 of arm 260. Alternatively, the electronic control circuit can be mounted to the framework of chair 12, being connected thereto by wires 263 as illustrated in FIG. 2.

Parts of the carriage housing interrupt the optic signal between the sensor pairs, thus indicating proximity of the travelling carriage. To gain precision in this operation, vanes 265 or the like protruberances are mounted to the housing 102 for this purpose, as shown in FIGS. 5–7. As shown in FIG. 2, for example, the pairs of sensors are spaced apart by intervening channels 251, 257, respectively to receive the vanes 265 mounted on the top and bottom walls of housing 102. Alternatively, infrared sensors and reflective strips can be employed, one on the carriage, the other on the frame 16. For example, sensors mounted near the ends of rack 50 can have an optic path therebetween completed by reflective surfaces of the carriage housing, when the carriage housing is sufficiently close to provide the needed angular positioning.

When the upper sensors 250, 252 detect carriage 100, a signal is communicated an electronic control circuit which initiates reversal of motor rotation, such that pinion gear 232 drives carriage 100 in a downward direction. Similarly, when a sensor pair 256, 258 detects carriage 100 at its lowermost excursion, signals sent to the control circuit 274 initiate a reversal of drive motor 190, such that the carriage is driven in an upward direction. Those skilled in the art will readily appreciate that energization of drive motor 190 could be interrupted or altered as desired, to slow down carriage movement as desired, or alternatively, the carriage can continuously reciprocate up and down along drive track 50.

Referring now to FIG. 10, operation of the kneading motor 192 will be described. Referring now to FIG. 10, the crank arms and cam are shown looking in the direction 10—10 of FIG. 8, thus cutting through output shaft 236 of motor 192. Motor rotation indicated by arrow 244 therefore appears in a clockwise direction in FIG. 10. At the cam position illustrated in FIG. 10, the massage rollers are in a fully retracted position. The circle 280 drawn in phantom indicates the path of maximum excursion of cam 240, as the cam is rotated about shaft 236. The forwardly facing surfaces of inner legs 124, 140 slide against cam 240 and accordingly, are displaced thereby as the cam rotates.

With clockwise rotation of arrow 244 in FIG. 10, the inner leg 140 is first displaced in a rearward direction and at maximum rearward deflection, assumes the position indicated in phantom at the bottom portion of FIG. 10. Thereafter, in sequence, the inner leg 124 is deflected to its maximum rearward point, indicated in the phantom in the top portion of FIG. 10. As the inner legs 124, 140 are rearwardly displaced, the cross arms 114, 116, and hence the rollers mounted thereon, are displaced in a forward position thus pushing against the chair back 12 and the back portion of an operator press thereagainst. Thus, the cross arms 114, 116 are alternately rocked in a forward direction, thus pressing against a user's back and providing a kneading action.

Figure 12:
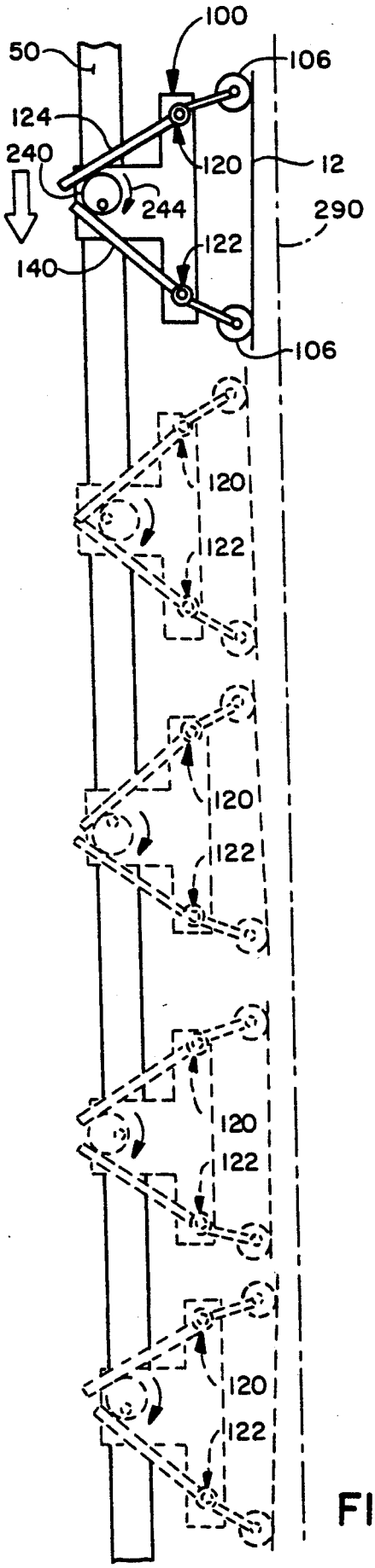
FIG. 12 is a diagrammatic illustration showing the travelling carriage at various positions along its path of travel, to further illustrate the kneading action of the massage applicators.

Referring now to FIG. 12, the motors 190, 192 can be simultaneously energized such that the kneading action occurs as carriage 100 is driven back and forth along drive rack 50. In FIG. 12, the dot-dash line 290 is shown for ready visual reference. Line 290 illustrates a reference plane parallel to drive rack 50, which is positioned slightly in front of the plane of chair back 12. The innermost surface of chair back 12 is illustrated schematically in FIG. 12 as a straight line extending between the upper and lower rollers 106. The straight line between the rollers is drawn as a visual aid for comparison to the reference plane 290. In reality, the chair back 12 is of a flexible fabric material and will conform to bend around surface portion of rollers 106 pressed thereagainst.

As explained above, as kneading motor 192 is energized to rotate cam 240, the upper and lower rollers are alternately rocked backward and forward. The top of FIG. 12 corresponds to a position adjacent sensors 250, 252 at the uppermost excursion of carriage 100, while the lowermost portion of FIG. 12 corresponds to a position adjacent sensors 256, 258, at the lowermost excursion of carriage 100. Three intermediate positions of carriage 100 are illustrated in FIG. 12 to aid in an explanation of the kneading action, and the cooperation between the displacement resulting from the simultaneous operation of motors 190, 192.

Thus, the carriage 100 reciprocates back and forth between the uppermost and lowermost positions illustrated in FIG. 12. Rotation of the output shaft 236 of motor 192 occurs independently of the rotation of drive motor 190. Thus, the rocking action imparted to crank arms 124, 140 is not synchronized with the traversal (traction movement) of travelling carriage 100. As illustrated in FIG. 12, the upper and lower rollers are rocked back and forth as the carriage travels between its upper and lower end points. Those skilled in the art will readily appreciate that the rotational speed of kneading motor 192 could be varied so as to provide virtually any number of repetitions as may be desired throughout the carriage travel.

Alternatively, the kneading motor 192 can be de-energized such that the massage rollers do not rock, but are merely rolled up and down to provide traction for a user's back. Alternatively, the carriage can be stopped at any position desired and the kneading motor 192 energized, so as to provide a kneading action at a localized portion of a user's back. As a further option, both motors 190, 192 can be stopped and vibrating motor 262 can be energized to provide a vibrating massage at a localized portion of a user's back. Of course, the vibrating motor can be used in combination with the drive motor, kneading motor, or both.

Referring to FIG. 12, the second position from the top shows the cam 240 maximally extended in a forward direction. In this position, the crank arms are brought to a maximum overlapping condition with the massage rollers retracted from the chair back. The second position from the bottom in FIG. 12 shows cam 240 in an opposite position, with a maximum rearward extension. This causes the massage rollers to be extended in a forward direction toward the chair back. Both upper and lower massage rollers are nearly extended a forward maximum amount, the bottom roller having just past the forward maximum point, and the upper roller quickly approaching and very nearly arriving at its maximum forward position.

As can be seen from the above, a "solid" or non-resilient drive connection is made between the motors 190, 192 and their associated moving parts driven thereby. This allows a maximum force to be developed by the moving parts, herein, either the kneading action of the rollers or the traction drive of the rack and pinion system. Also, due to the "hard" connection of the moving parts rocking or unusual movements of the massaging apparatus or parts thereof, are avoided. Thus, comfort to the user is achieved and annoying or surprising movements are eliminated. Further costs advantages are realized in that the motors can be of a smaller size since they are more efficiently utilized.

Quite importantly, the massage apparatus according to principles of the present invention, provides a strong support base against which force developed by the motors can be developed. For example, it is important that the pinion gear 232 driven by motor 190 be held in engagement with the gear rack 50, as the carriage is reciprocated between its end points. Such engagement is reliably attained with the present invention, by guide bars 68, 70 located in front of and to each side of the gear rack 50. The aforementioned continuous tubular bushings extending through housing 102, further contribute to the "tight" mechanical connection between the pinion gear and rack, despite various distortions which might otherwise be introduced to the forces applied to the massage rollers, and the supports therefor.

For example, assuming the kneading motor 192 is deactivated, as the upper and lower rollers are traversed across a user's back, varying amounts of rearward pressure are experienced by the rollers. However, such does not result in a rearward deflection, because of the aforedescribed mounting of the rollers and in particular, the crank arms which support the rollers. With two guide bars being employed, one on each side of the gear rack, a twisting of the carriage about an imaginary axis, parallel to that of the gear rack is avoided, and again wear on the rack and pinion gear is reduced to a minimum, and constant engagement therebetween is assured. Also, the elongated bushings 206, 208 supporting housing 102 at its upper and lower walls, eliminates rocking or torsion displacement of the carriage assembly about an imaginary axis extending through the housing cross-section, in a direction perpendicular to the axis of gear rack 50. Such torsional displacement is eliminated, even though a substantial pressure is developed in either the top or bottom pair of rollers, but not both, the housing thereby being in an unbalanced position. Also, the elongated bushings 206, 208 continuously extending through the housing prevent a rocking suggestive of a pitch.

The drawings and the foregoing descriptions are not intended to represent the only forms of the invention in regard to the details of its construction and manner of operation. Changes in form and in the proportion of parts, as well as the substitution of equivalents, are contemplated as circumstances may suggest or render expedient; and although specific terms have been employed, they are intended in a generic and descriptive sense only and not for the purposes of limitation, the scope of the invention being delineated by the following claims.

What is claimed is:

1. Massage apparatus comprising:

track means;

a travelling carriage mounted for movement along the track means;

a housing on said carriage;

at least one massaging element carried by said housing;

a pair of motors in said housing, including a drive motor for driving said carriage along said track means, and a kneading motor with unidirectional output for driving said massaging element with a pulsating pressure;

a crank arm for rotatably mounting said massage element; and pivot means for pivoting said crank arm, including a cam contacting the crank arm, driven by the kneading motor.

2. Massage apparatus comprising:

a pair of spaced guide bars;

a travelling carriage mounted for movement along the pair of spaced guide bars, between first and second end portions;

a housing on said carriage;

at least one massaging element carried by said carriage;

a drive bar between said guide bars;

a drive motor in said housing for driving said carriage along said drive bar;

said pair of guide bars and at least a portion of said drive bar extend through said housing;

mounting means for rotatably mounting a pair of said massage elements, one laterally opposite the other, said mounting means comprising a first double-ended shaft, each end mounting a massage element, and a first crank arm having a first end for mounting the shaft; and kneading means for applying pulsating pressure with said massage element while travelling between end portions of said guide bars, said kneading means comprising a pivot mounting for said crank arm, a cam in contact with said crank arm and a kneading motor in said housing for driving said cam.

3. The apparatus of claim 2 wherein said drive motor and said kneading motor are laterally opposite one another, on either side of said drive bar.

4. The apparatus of claim 2 wherein the mounting means further comprises a second double-ended shaft, each end thereof mounting a massage element, and a second crank arm having a first end for mounting the shaft, the first and second crank arms driven by said cam.

5. The apparatus of claim 4 wherein the first and second crank arms comprise a dogleg with an intermediate pivot point and a free end contacting said cam.

6. The apparatus of claim 5 wherein the free ends are disposed side-by-side, at axially adjacent positions on said output shaft.

7. The apparatus of claim 6 wherein the first and second crank arms have an intermediate pivot mounting disposed between laterally offset legs, one leg mounting said shaft, the legs laterally offset one from the other to engage said cam at one side of said gear rack.

8. Massage apparatus comprising:

track means;

a travelling carriage mounted for movement along the track means, between first and second end portions;

a housing on said carriage;

at least one pivotally mounted crank arm;

at least one massaging element rotatably mounted to said crank arm;

a pair of motors in said housing, including a drive motor for driving said carriage along said track means and a kneading motor for driving said crank arm so as to apply a pulsating pressure with said massaging element; and a cam driven by said kneading motor in contact with the crank arm for pivoting displacement thereof.

9. The apparatus of claim 8 wherein said track means comprises a pair of spaced guide bars, and said motors laterally oppose one another, one adjacent each guide bar.

10. The apparatus of claim 9 wherein said track means further comprises a drive bar between said pair of guide bars, said motors lying on opposite sides of said drive bar.

11. The apparatus of claim 10 wherein said pair of guide bars and at least a portion of said drive bar extend through said housing.

12. The apparatus of claim 8 wherein said drive motor is reversible, said apparatus further comprising sensors at end portions of said drive bar coupled to said drive motor to send an electrical signal thereto to reverse the direction of rotation thereof.

13. The apparatus of claim 12 wherein said sensors comprise photocell means, said apparatus further comprising electronic circuit means carried by said carriage and coupled to said sensors and to said drive motor for controlling the direction of rotation of said drive motor.

14. The apparatus of claim 13 further comprising a control housing on said carriage, enclosing said electronic circuit means.

15. The apparatus of claim 8 wherein the kneading motor is unidirectional and includes a cam contacting the crank arm for pivoting thereof.

16. The apparatus of claim 8 further comprising a vibration producing motor supported by said carriage.

* * * * *